United States Patent [19]

Ishiyama et al.

[11] 4,436,491

[45] Mar. 13, 1984

[54] METHOD OF SUPPLYING HYDRAULIC OPERATING FLUID IN DIAPHRAGM TYPE

[75] Inventors: Masashi Ishiyama, Minami-ashigara; Michinori Ishibashi, Higashimurayama, both of Japan

[73] Assignees: Fuji Photo Film Co., Ltd.; Nikkiso Co., Ltd., of JPX

[21] Appl. No.: 345,704

[22] Filed: Feb. 4, 1982

Related U.S. Application Data

[63] Continuation of Ser. No. 107,647, Dec. 27, 1979, abandoned.

[30] Foreign Application Priority Data

Dec. 20, 1978 [JP] Japan ..... 53-161579

[51] Int. Cl.[3] ..... F04B 9/10

[52] U.S. Cl. ..... 417/385; 91/402

[58] Field of Search ..... 417/385, 386, 387, 388; 251/35; 91/402

[56] References Cited

U.S. PATENT DOCUMENTS

| | | | |
|---|---|---|---|
| 1,797,245 | 3/1931 | Schaer | 417/387 |
| 2,578,746 | 12/1951 | Scherger et al. | 417/388 |
| 2,753,805 | 7/1956 | Boivinet | 417/388 |
| 3,494,294 | 2/1970 | Hetz | 417/387 |

FOREIGN PATENT DOCUMENTS

| | | | |
|---|---|---|---|
| 43-15407 | 6/1968 | Japan | 417/385 |
| 45-29153 | 11/1970 | Japan | 417/385 |
| 50-32121 | 10/1975 | Japan | 417/385 |

*Primary Examiner*—Leonard E. Smith

*Attorney, Agent, or Firm*—Eyre, Mann, Lucas & Just

[57] ABSTRACT

In a diaphragm type pump, a minute amount of the operating fluid is supplied instantaneously from an oil reservoir to an operating chamber at the final stage of the suction stroke in a main cylinder, and an excessive amount of the operating fluid and/or bubbles are discharged into the oil reservoir in the delivery stroke in the main cylinder. The minute amount of the operating fluid is within the range of 0.1 to 2% of the whole volume of displacement of diaphragm.

3 Claims, 1 Drawing Figure

METHOD OF SUPPLYING HYDRAULIC OPERATING FLUID IN DIAPHRAGM TYPE

This is a continuation of application Ser. No. 107,647, filed Dec. 27, 1979, now abandoned.

BACKGROUND OF THE INVENTION

1. Field of the Invention

This invention relates to an improvement in a diaphragm type pump, and more particularly to a method of supplying a hydraulic operating fluid in a diaphragm type pump for preventing degradation of the pulsation rate and the volumetric efficiency.

2. Description of the Prior Art

In a diaphragm type pump, it is ideally desired that the fluid be pumped with 100% volumetric efficiency. In practical use, however, the volumetric efficiency cannot be raised over 99% and there is a pulsation rate of about 1%.

In the conventional diaphragm type pump, it is difficult to maintain the pulsation rate and the volumetric efficiency at such levels for a long period. As the operating time lapses, these performance factors are both degraded, that is the pulsation rate is raised and the volumetric efficiency is lowered.

For instance, when a latex fluid is pumped with the diaphragm type pump for 30 hours, the pulsation rate which is initially about ±1% is raised up to about ±5%, and the volumetric efficiency which is initially about 99% is lowered to about 94%. With the degradation of these factors, the discharge fluctuation is also increased from about 2% to about 5%.

The above-mentioned degradation is caused by the cavitation generated in the operating chamber as the plunger reciprocates to drive the diaphragm. The cavitation is generated every time the pressure within the hydraulic oil operating chamber is reduced as the plunger reciprocates and is accumulated therein as the operation is repeated for a long period.

The diaphragm type pump is suitable for pumping a material like latex which tends to aggregate by a shearing stress and is liable to choke spaces between slidable members in the pump, since the diaphragm type pump does not have any slidable portion which is in direct contact with the pumped fluid. Further, particularly when a highly accurate constant feeding of fluid is desired, the diaphragm type pump of hydraulic pressure type not of direct-acting type is preferred. However, the diaphragm type pump of hydraulic pressure type has a defect as mentioned hereinbefore in that the cavitation is accumulated within the operating chamber during a long period operation and the pulsation rate and the volumetric efficiency are degraded.

In order to solve the above problems inherent in the conventional diaphragm type pump of hydraulic pressure type, it has been known in the art to automatically supply an operating fluid to the operating chamber as well as deair the bubbles within the operating chamber as disclosed for instance in Japanese Utility Model Publication Nos. 43(1968)-15407, 45(1980)-29153 and 50(1975)-32121. These devices use only one valve for these purposes.

The above-mentioned conventional devices for conducting the deairing and oil supply by use of a single valve has a defect in that the accurate control of the amount of deairing and oil supply is difficult inpractice.

In practical use, therefore, the above-mentioned conventional devices are insufficient in operation.

SUMMARY OF THE INVENTION

In view of the above-mentioned defects inherent in the conventional diaphragm type pump, it is the primary object of the present invention to provide a method of supplying a hydraulic operating fluid or oil to an operating chamber of a diaphragm type pump in which the amount of the supplied oil can be accurately controlled.

Another object of the present invention is to provide a method of supplying a hydraulic operating fluid or oil to an operating chamber of a diaphragm pump in which the pulsation rate and the volumetric efficiency are maintained in their desirable level for a long period of operation.

The method of supplying a hydraulic operating fluid to the operating oil chamber in accordance with the present invention is characterized in that a minute amount of operating fluid is instantaneously supplied to the operating chamber in synchronization with the reciprocal movement of the plunger and simultaneously therewith an excess amount of operating fluid and/or bubbles is discharged from the chamber. In other words, at the final stage of the suction stroke of the main cylinder, the operating fluid of very small amount corresponding to about 0.1 to 2% of the whole volume of displacement of the diaphragm is supplied to the operating chamber instantaneously by means of an automatic supply means, and an excessive amount of operating fluid and/or bubbles is discharged from the operating chamber to an oil reservoir by means of an automatic discharge means in the delivery stroke in the main cylinder.

Thus, the supply of the minute amount of oil and the discharge of the excessive oil are repeated in synchronization with the suction and delivery strokes in the main cylinder, whereby the generation of the cavitation within the hydraulic operating chamber is effectively controlled and the degradation of the volumetric efficiency of the pump is prevented and further the pulsation rate is maintained at a desired level.

DESCRIPTION OF THE PREFERRED EMBODIMENT

Figure 1:
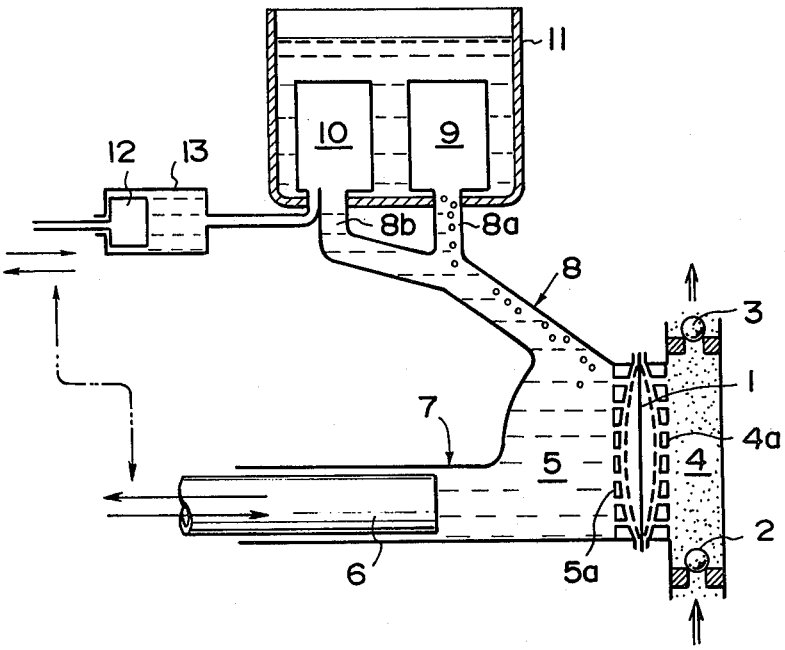
FIG. 1 a schematic sectional view of the diaphragm type pulseless pump embodying the present invention.

Now the present invention will be described in detail with reference to FIG. 1. With the intervention of a diaphragm 1, a pump chamber 4 provided with an intake valve 2 and a discharge valve 3 is provided adjacent to a hydraulic operating chamber 5. The operating chamber 5 is provided in a part thereof with a main cylinder 7 in which a main plunger 6 is slidably inserted. On the pump chamber side of the diaphragm 1 is located a distributor plate 4*a* for limiting the movement of the diaphragm 1 on the pump chamber 4 side. On the operating chamber side of the diaphragm 1 is located a distributor plate 5*a* for limiting the movement of the diaphragm 1 on the operating chamber 5 side. The latter distributor plate 5*a* also functions to pass the operating fluid from the operating chamber 5 to the diaphragm therethrough. The diaphragm 5 functions to conduct a pumping operation as well known in the art by moving back and forth between the distributor plates 4*a* and 5*a*.

The upper portion of the hydraulic operating chamber 5 is communicated with an automatic discharge device 9 and an oil supply device 10 by way of a manifold 8. The manifold 8 is oriented at an inclined angle so that there will not stay any bubbles therein in the upper portion of the operating chamber 5. The upper end of the manifold 8 is branched into a discharge pipe portion 8*a* connected with the automatic discharge device 9 and a supply pipe portion 8*b* connected with the oil supply device 10. The automatic discharge device 9 and the oil supply device 10 are retained in an oil reservoir 11.

The oil supply device 10 is connected with an external hydraulic pressure cylinder 13 provided with a plunger 12 so that an external pressure is exerted thereto for supplying an oil when the oil is to be supplied. The plunger 12 of this external hydraulic pressure cylinder 13 for supplying the oil and the main plunger 6 of the main cylinder 7 are synchronized with each other with the operating phase shifted by a half period so that the plunger 12 of the external hydraulic pressure cylinder 13 is at the initial stage of the delivery stroke when the plunger 6 of the main cylinder 7 is at the final stage of the suction stroke that is when the pressure within the operating chamber 5 is reduced and the necessary oil is supplied to the operating chamber 5.

The method of supplying the hydraulic operating fluid in accordance with this invention is characterized in that the supply of the operating fluid is conducted instantaneously by a very small amount. Particularly, the method of this invention is characterized in that the operating fluid of the amount of only about 0.1 to 2% of the whole volume of the displacement of the diaphragm is supplied to the operating chamber at the final stage of the suction stroke in the main cylinder. Further, on the other hand, by discharging the excessive oil while the main cylinder is in its delivery stroke, the amount of the operating fluid in the operating chamber is maintained constant so that the fluid feeding can be performed without pulsation.

In accordance with the present invention, since the generation of the cavitation in the operating fluid within the operating chamber at the final stage of the suction stroke in the main cylinder is prevented, the generation of bubbles can be controlled. In the event there are generated bubbles during a long period of operation notwithstanding, the bubbles can be discharged through the automatic discharge device 9 together with an excess oil. As the automatic discharge device 9 can be used an automatic discharge valve which has been used in the prior art.

Figure 2:
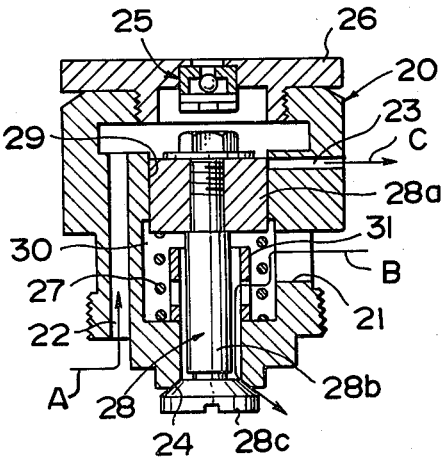
FIG. 2 is a detailed sectional view showing the structure of an oil supply valve employed in the pump as shown in FIG. 1.

As the oil supply device 10, a valve means as shown in FIG. 2 can be used. Referring to FIG. 2, the valve means 20 has on the side wall thereof an operating fluid guide-in port 21 for introducing the oil from the oil reservoir 11 into the valve means 20, an external pressure oil guide path 22 for introducing the pressured operating fluid into the valve means 20 from the external hydraulic pressure cylinder 13 (this operating fluid will hereinbelow be referred to as "external pressure oil"), and a leakage path 23 for the external pressure oil. The valve means 20 has on the bottom thereof an operating fluid supply port 24 for supplying the operating fluid to the operating chamber 5, and on the top thereof a removable lid 26 provided with a check valve 25 for checking the communication between the interior of the valve means 20 and the oil reservoir 11. The valve means 20 further has at the center thereof a valve rod 28 extending vertically through said operating fluid supply port 24, which is moved downward by the external pressure oil and moved upward by a compression spring 27. The valve rod 28 extends vertically through an upper cylinder 29 and a lower cylinder 30 formed in the valve means 20 in the upper and lower positions thereof and projects downward out of the lower cylinder 30 at said operating fluid supply port 24. The valve rod 28 consists of a rod portion 28*b* extending vertically through said upper and lower cylinders 29 and 30, an upper valve head 28*a* fixed to the upper part of the rod portion 28*b* and extending through the upper cylinder 29 to choke the upper cylinder 29, and a lower valve head 28*c* fixed to the lower part of the rod portion 28*b* and projected outward from the operating fluid supply port 24 to open and close to port 24. Within the lower cylinder 30, said compression spring 27 acting to spring urge the upper valve head 28*a* upward and a stopper ring 31 limiting the downward movement of the upper valve head 28*a* are provided concentrically with the rod portion 28*b*. Said leakage path 23 for the external pressure oil is located at an upper level of the wall of the upper cylinder 29 with which the upper valve head 28*a* is slidable in contact so that the leakage path 23 is closed with the upper valve head 28*a* when the valve rod 28 is in its upper position and is opened when the valve rod 28 is in its lower position. In FIG. 2, the arrow A indicates the course of the incoming external pressure oil, the arrow B indicates the course of the supply of the operating fluid, and the arrow C indicates the course of leakage of the external pressure oil.

Now the operation of the above-described pump acting in accordance with the present invention will be described in detail referring to FIGS. 1 and 2.

With a driving source not shown, the main plunger 6 of the main cylinder 7 is reciprocated back and forth and thereby the diaphragm 1 is moved back and forth and the intake valve 2 and the discharge valve 3 of the pump chamber 4 are alternately opened and closed to feed the fluid like latex upward. At the final stage of the suction stroke in the main plunger 6 that is the stage where the main plunger 6 is in the left side end of the reciprocal movement, the plunger 12 of the external cylinder 13 is moved to the right in its discharge stroke to pressure the external pressure oil into the valve means 20 in a region above the upper cylinder 29 through the external pressure oil guide path 22. The external pressure oil pushes the upper valve head 28*a* of the valve rod 28 downward, whereby the valve rod 28 is moved downward and the lower valve head 28*c* opens the operating fluid supply port 24. Since the pressure of the operating chamber 5 is reduced at this stage, the operating fluid within the oil reservoir 11 is supplied into the supply pipe portion 8*b* of the manifold 8 passing through the operating fluid guide-in port 21 and the operating fluic supply port 24 along the course of supply B. At this stage, since the leakage path 23 is opened by the downward movement of the upper valve head 28*a*, the external pressure oil leaks into the oil reservoir 11 through the leakage path 23. Therefore, the action to move the valve rod 28 downward is terminated. On the other hand, the downward movement of the valve rod 28 is limited by abutment of the lower end of the upper valve head 28*a* on the upper end of the stopper ring 31, and the valve rod 28 is stopped at the position. Then, upon termination of the action by the external pressure oil to move the valve rod 28 downward, the upper valve head 28*a* is moved upward by the force of the compression spring 27. Thus, the valve rod 28 starts to move upward.

The valve rod 28 is thus returned to its original upper position immediately. Therefore, the supply of the operating fluid is made only instantaneously at the final stage of the suction stroke in the main cylinder 7. The amount of the supplied operating fluid and the time of supplying the operating fluid can be selected as desired by selecting and setting the pressure or force of the compression spring 27, the upper end position of the stopper ring 31 and the size and number of the external pressure oil leakage paths 23. Therefore, it is readily accomplished to make the amount of the oil supply about 0.1 to 2% of the whole volume of displacement of the diaphragm. According to the tests conducted by the inventors of the present invention, the most favorable results were obtained when the amount of oil supply was 0.2 to 1% within the preferred range of 0.1 to 2%.

In the above described invention, since the supply of the operating fluid is conducted instantaneously, it is impossible to discharge the excessive oil or bubbles by means of the valve means used for supplying the operating fluid. Therefore, in order to discharge the excessive oil or the bubbles, a separate discharge device is provided to discharge them in the delivery stroke in the main cylinder 7.

In accordance with the method of this invention, the generation of bubbles is prevented. During a long period of operation, however, there may be generated some bubbles. Such bubbles are discharged by use of said discharge device.

According to the inventor's tests, it has been confirmed that the pulsation rate of ±1% and the volumetric efficiency of 99% were maintained as long as 38 days in the system utilizing the present invention in which latex was pumped with about 1% of supply of operating fluid with respect to the whole volume of the displacement of the diaphragm.

We claim:

1. In the method of supplying hydraulic operating fluid in a diaphragm type pump in which a diaphragm is driven by an operating fluid and operating fluid is supplied to an operating chamber from an oil reservoir at the final stage of a suction stroke in the main cylinder of the pump, the improvement comprising instantaneously supplying a predetermined minute amount, between about 0.1 and about 2% of the whole volume of the displacement of the diaphragm, of operating fluid, said predetermined minute amount being delivered through a valve, (a) said valve being provided with a piston in a chamber operating between an enable position wherein operating fluid from said reservoir can pass to said operating chamber and a disable position wherein passage of said operating fluid is blocked;

(b) being urged into its disable position by a spring;

(c) said piston being urged by a selectively applied external pressure oil to move it to its enable position;

(d) said valve being provided with a leakage hole in the wall of the chamber, said leakage hole being just below the top of the piston when the piston is in the disable position and being blocked by the piston when the piston is in the disable position and being open to passage of the external pressure oil when the piston is in the enable position.

2. The method of claim 1 wherein the said predetermined minute amount is between about 0.2 and about 1% of the whole volume of the displacement of the diaphragm.

3. The method of claim 1 wherein the piston travel toward the enable position is limited by a stop member.

* * * * *